US008499812B1

(12) United States Patent
Guerra

(10) Patent No.: US 8,499,812 B1
(45) Date of Patent: Aug. 6, 2013

(54) TAPE DISPENSING SYSTEM

(76) Inventor: William Guerra, Hialeah, FL (US)

( * ) Notice: Subject to any disclaimer, the term of this patent is extended or adjusted under 35 U.S.C. 154(b) by 131 days.

(21) Appl. No.: 13/247,722

(22) Filed: Sep. 28, 2011

(51) Int. Cl.
*B65D 85/12* (2006.01)
*B65H 35/07* (2006.01)

(52) U.S. Cl.
USPC ..... 156/577; 156/574; 225/77; 225/78

(58) Field of Classification Search
USPC ..... 156/574, 577, 578; 225/77, 78
See application file for complete search history.

(56) References Cited

U.S. PATENT DOCUMENTS 2,295,477 A * 9/1942 Jackson ..... 225/26
2,891,691 A * 6/1959 Burger ..... 156/577
3,217,955 A * 11/1965 Tinkey ..... 225/47
5,038,492 A * 8/1991 Bryant et al. ..... 33/758
5,236,540 A * 8/1993 Shi ..... 156/523
5,698,067 A * 12/1997 Packard ..... 156/577
5,770,007 A * 6/1998 Czech et al. ..... 156/540
8,286,682 B2 * 10/2012 Wu ..... 156/577
2005/0006423 A1 * 1/2005 Kjeldsen et al. ..... 225/47
2005/0145343 A1 * 7/2005 Somers et al. ..... 156/577
2005/0241090 A1 * 11/2005 Bogman ..... 15/121
2007/0267148 A1 * 11/2007 Steele et al. ..... 156/577
2008/0067211 A1 * 3/2008 Steele et al. ..... 225/77

* cited by examiner

*Primary Examiner* — Mark A Osele
(74) *Attorney, Agent, or Firm* — Albert Bordas, P.A.

(57) ABSTRACT

A tape dispensing system having an interior dispenser frame with an interior wall. The interior wall has lateral edges. Extending between the lateral edges are a curved edge and a corner. The interior dispenser frame also has a top wall having its lateral edges. Extending between those lateral edges is a first locking edge. The first locking edge has a locking cut out. The interior dispenser frame has a dispenser spool assembly with a first base. Extending from the first base are concave sections, the concave sections being connected by convex sections. An exterior dispenser plate has an exterior wall. The exterior wall also has lateral edges. Extending between those lateral edges are a curved edge and another locking edge. This locking edge also has a locking cut out. The exterior dispenser plate further has a plate spool assembly with a circular wall.

20 Claims, 5 Drawing Sheets

TAPE DISPENSING SYSTEM

BACKGROUND OF THE INVENTION

1. Field of the Invention

The present invention relates to tools, and more particularly, to tape dispensing systems.

2. Description of the Related Art

Applicant is not aware of any tape dispensing systems having the novel features of the present invention.

SUMMARY OF THE INVENTION

The instant invention is a tape dispensing system, comprising, an interior dispenser frame having an interior wall. The interior wall has first and second lateral edges. Extending between the first and second lateral edges are a first curved edge and a corner. The interior dispenser frame also comprises a top wall having third and fourth lateral edges. Extending between the third and fourth lateral edges is a first locking edge. The first locking edge comprises at least one first locking cut out. The top wall further comprises at least one elongated cut out extending from the first locking edge toward the corner. The interior dispenser frame further comprises a dispenser spool assembly having a first base. Extending from the first base is a plurality of concave sections extending toward a first front wall, said plurality of concave sections being connected by a respective plurality of convex sections. An exterior dispenser plate comprises an exterior wall. The exterior wall has fifth and sixth lateral edges. Extending between the fifth and sixth lateral edges are a second curved edge and a second locking edge. The second locking edge comprises at least one second locking cut out. The exterior dispenser plate further comprises a plate spool assembly comprising a circular wall that extends a first predetermined distance from the exterior wall onto a second base.

It is therefore one of the main objects of the present invention to provide a tape dispensing system that is removably mounted to a user's belt.

It is another object of this invention to provide a tape dispensing system comprising a removable application squeegee.

It is another object of this invention to provide a tape dispensing system that is volumetrically efficient for carrying, transporting, and storage.

It is another object of this invention to provide a tape dispensing system that can be readily assembled and disassembled without the need of any special tools.

It is another object of this invention to provide a tape dispensing system, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
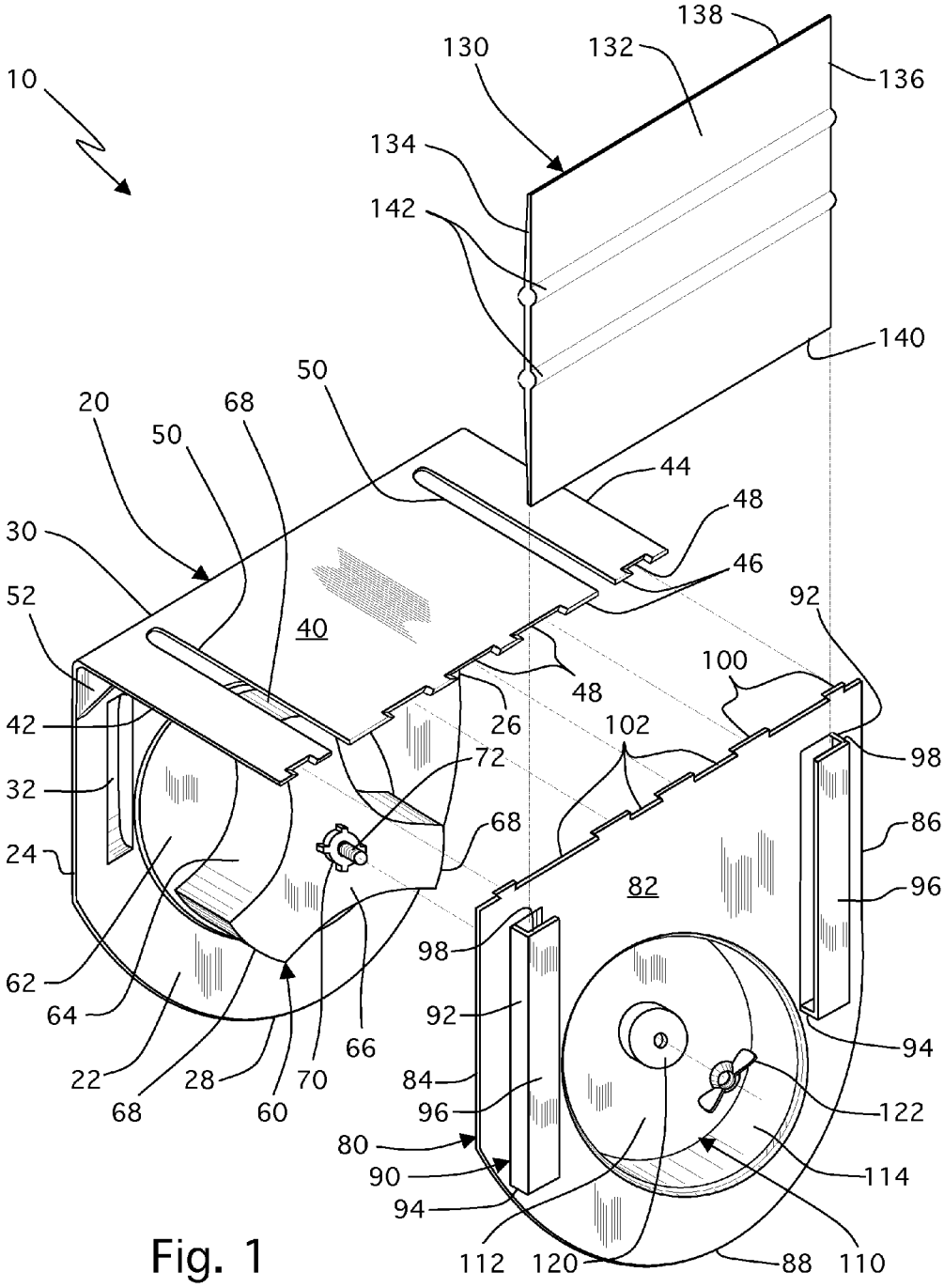
FIG. 1 represents a front isometric exploded view of a tape dispensing system, object of the present application.

Referring now to the drawings, the present invention is generally referred to with numeral 10. It can be observed that it basically includes interior dispenser frame 20, exterior dispenser plate 80 and application squeegee 130.

Figure 2:
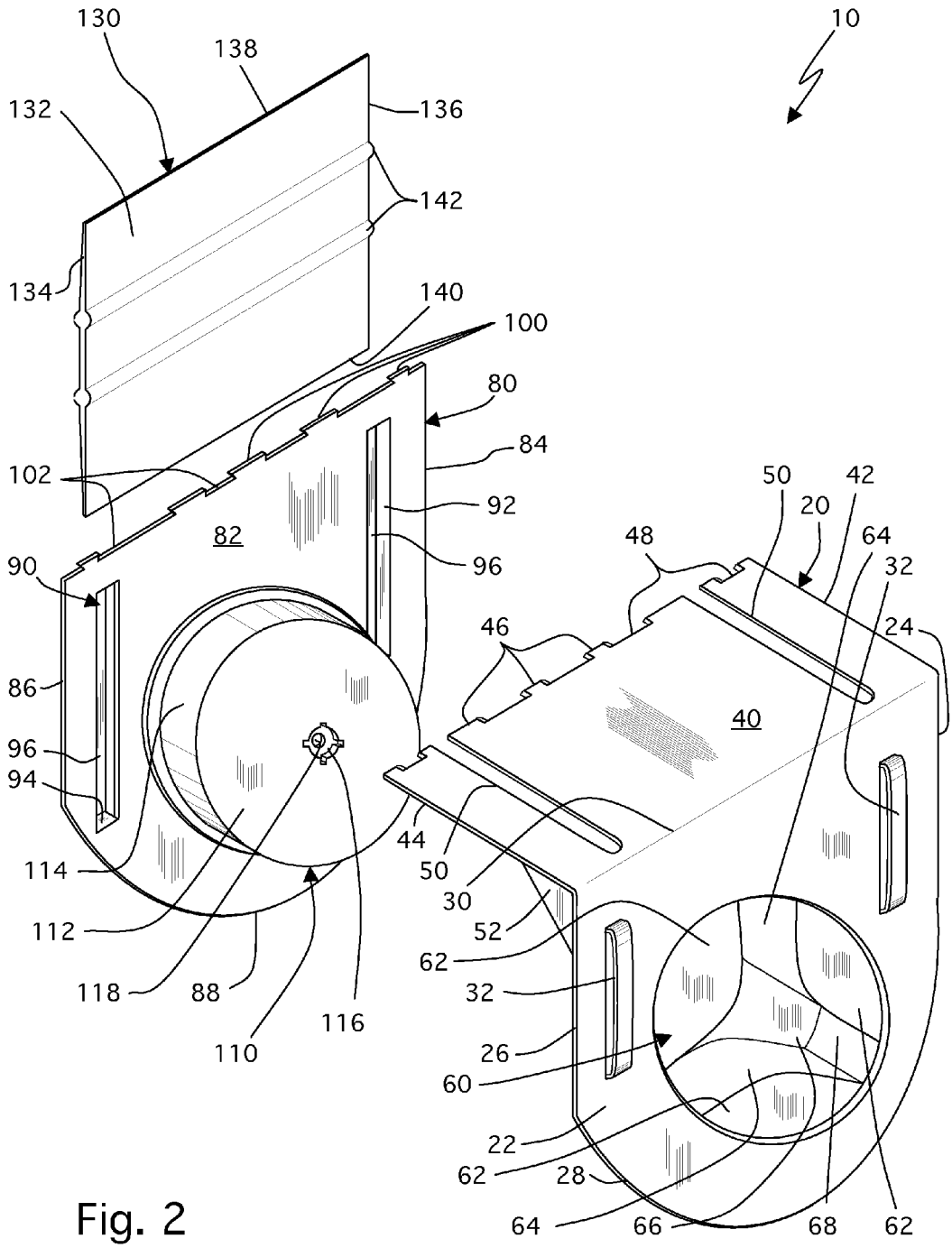
FIG. 2 is a rear isometric exploded view of the instant invention.

As seen in FIGS. 1 and 2, interior dispenser frame 20 comprises interior wall 22 with lateral edges 24 and 26. Extending between lateral edges 24 and 26 are curved edge 28 and corner 30. Interior wall 22 further comprises at least one belt loop 32.

Interior dispenser frame 20 also comprises top wall 40 extending from corner 30 in an approximately perpendicularly disposition with respect to interior wall 22. Top wall 40 has lateral edges 42 and 44. Extending between lateral edges 42 and 44 is a locking edge 46 with at least one locking cut out 48. Top wall 40 further comprises elongated cutouts 50 extending a predetermined distance from locking edge 46 toward corner 30 without reaching corner 30. Elongated cutouts 50 are parallel to each other. Elongated cut outs 50 are at a predetermined distance from lateral edge 42 and lateral edge 44, respectively. Reinforcement walls 52 extend between top wall 40 and interior wall 22.

Interior dispenser frame 20 further comprises dispenser spool assembly 60 with base 62 mounted to interior wall 22. Extending approximately perpendicular from base 62 is a plurality of concave sections 64 that extends toward front wall 66. Concave sections 64 are connected by a respective plurality of convex sections 68. Front wall 66 is parallel to base 62. As best seen in FIG. 1, dispenser spool assembly 60 further comprises male locking member 70 mounted on front wall 66 and bolt 72 protruding therefrom.

Exterior dispenser plate 80 comprises exterior wall 82 with lateral edges 84 and 86. Extending between lateral edges 84 and 86 are curved edge 88 and locking edge 100. Locking edge 100 comprises locking cut outs 102. Exterior dispenser plate 80 also comprises plate spool assembly 110 having circular wall 114 that extends a predetermined distance from exterior wall 82 to base 112. Plate spool assembly 110 further comprises protruding mount 120 mounted on base 112. Protruding mount 120 has through hole 118 and female locking member 116. Female locking member 116 has cooperative shape to receive male locking member 70.

Exterior dispenser plate 80 further comprises rail assemblies 90. Each rail assembly 90 comprises lateral wall 92 and front wall 96 extending from edge 98 to base wall 94. Lateral walls 92 and respective front walls 96 form an L-shape.

Application squeegee 130 has wall 132 defined by lateral edges 134 and 136 and edges 138 and 140. Elongated protrusions 142 extend parallel to each other from lateral edge 134 to lateral edge 136. Elongated protrusions 142 help a user to insert and remove application squeegee 130 from rail assemblies 90.

Figure 3:
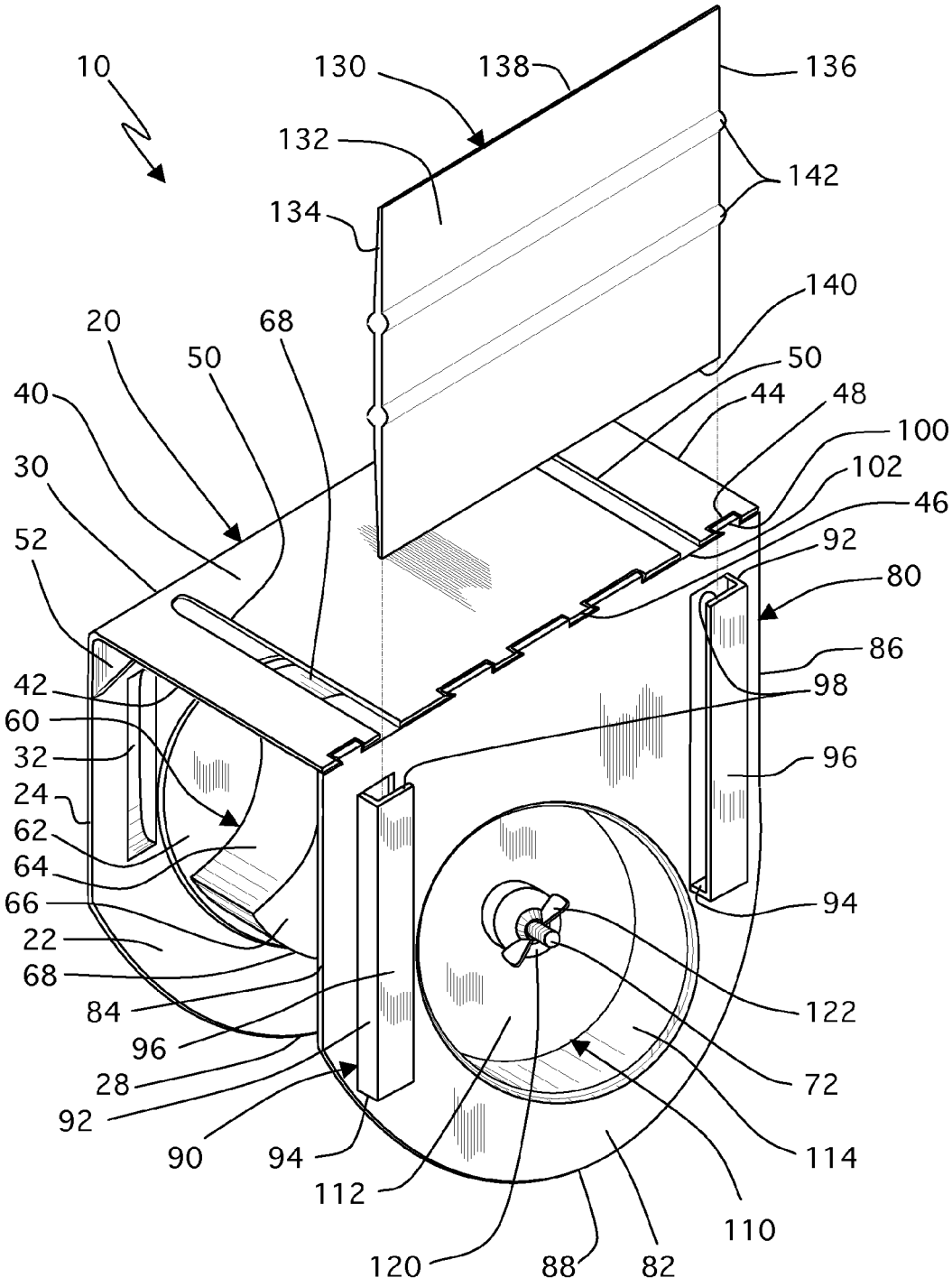
FIG. 3 is a front isometric view of the instant invention assembled. The application squeegee is shown unmounted.

As seen in FIG. 3, through hole 118 receives bolt 72 when front wall 66 is biased against base 112. Bolt 72 receives wing nut 122.

Figure 4:
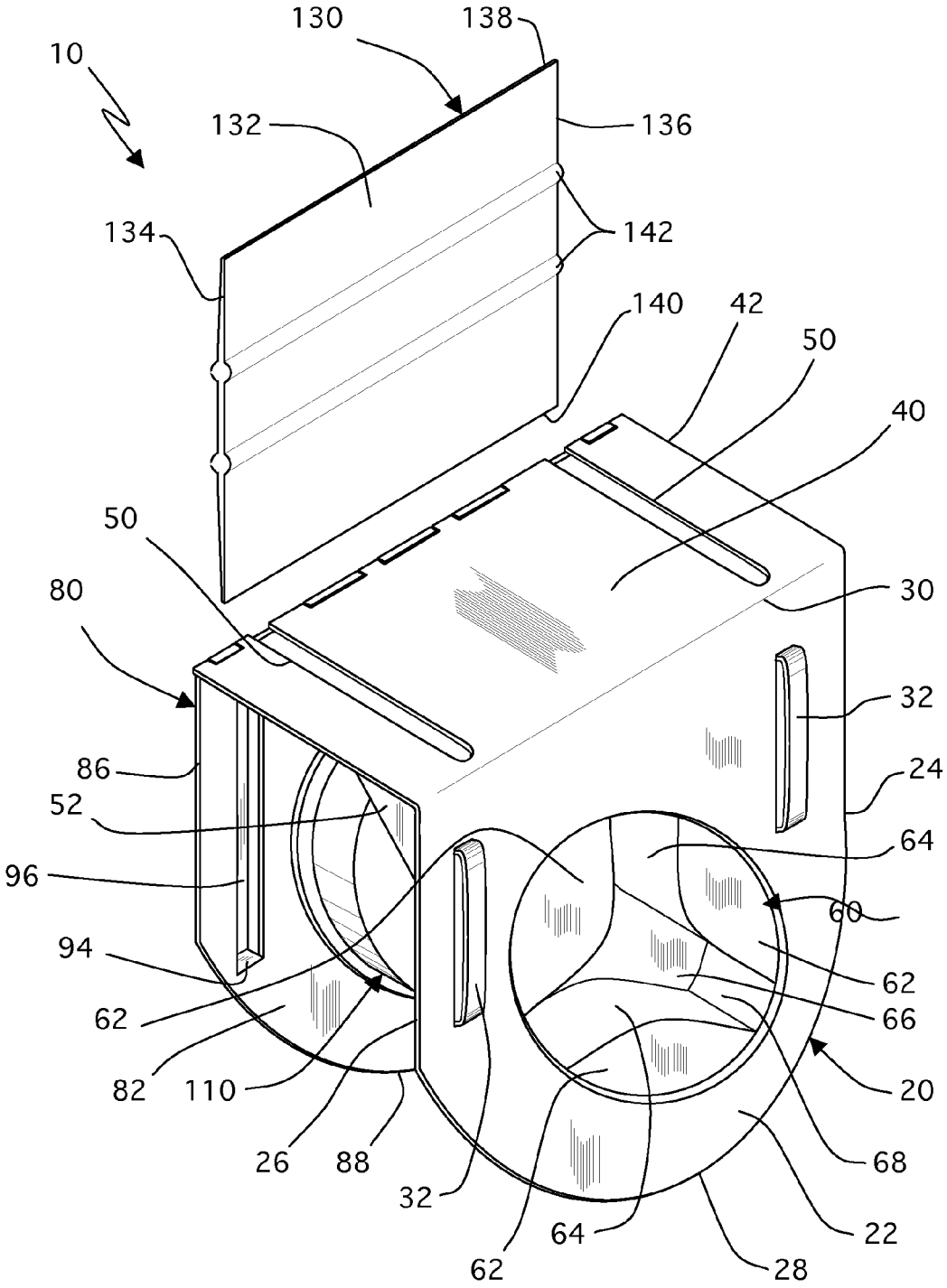
FIG. 4 is a rear isometric view of the instant invention assembled. The application squeegee is shown unmounted.

As seen in FIGS. 3 and 4, top wall 40 is perpendicular to exterior wall 82 while interior wall 22 and exterior wall 82 are parallel to each other. Locking cut outs 48 receives locking edge 100 and locking cut outs 102 cooperatively receive locking edge 46 when interior dispenser frame 20 is joined to exterior dispenser plate 80. Rail assemblies 90 are cooperative in shape and dimensions to snuggly receive application squeegee 130.

Figure 5:
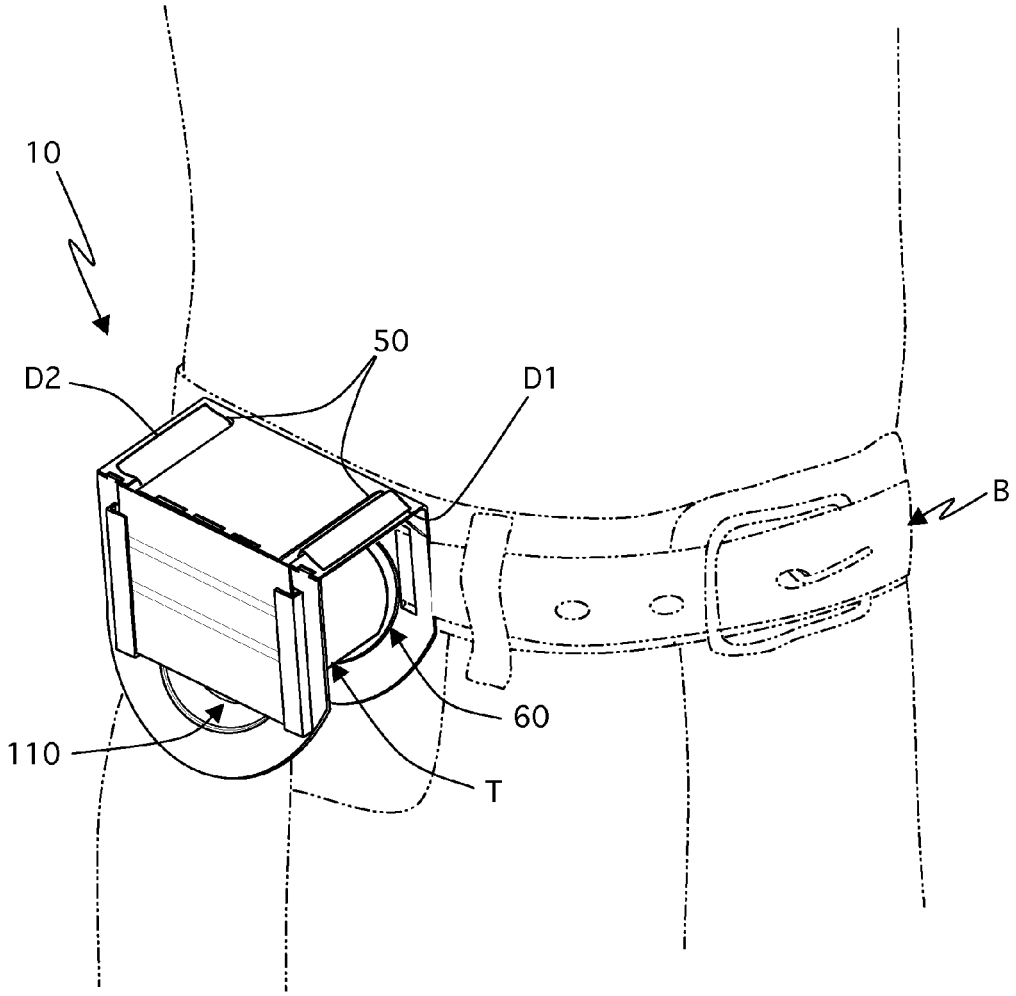
FIG. 5 is an isometric view of the instant invention assembled and mounted onto a belt of a user.

As seen in FIG. 5, dispenser spool assembly 60 and plate spool assembly 110 receive a roll of tape T. Distal end D1 of roll of tape T dispenses through one of elongated cut outs 50. When tape T has a protector cover, such as aluminum tape, distal end D1 is dispensed through one of the elongated cut outs 50, while distal end D2 of roll of tape T is dispensed through another elongated cut out 50. Belt loops 32 receive user's belt B therethrough when tape dispensing system 10 is in use.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A tape dispensing system, comprising:

A) an interior dispenser frame having an interior wall, said interior wall having first and second lateral edges, extending between said first and second lateral edges are a first curved edge and a corner, said interior dispenser frame also comprising a top wall having third and fourth lateral edges, extending between said third and fourth lateral edges is a first locking edge, said first locking edge comprising at least one first locking cut out, said top wall further comprising at least one elongated cut out extending from said first locking edge toward said corner, said interior dispenser frame further comprising a dispenser spool assembly having a first base, extending from said first base is a plurality of concave sections extending toward a first front wall, said plurality of concave sections being connected by a respective plurality of convex sections; and B) an exterior dispenser plate comprising an exterior wall, said exterior wall having fifth and sixth lateral edges, extending between said fifth and sixth lateral edges are a second curved edge and a second locking edge, said second locking edge comprising at least one second locking cut out, said exterior dispenser plate further comprising a plate spool assembly comprising a circular wall that extends a first predetermined distance from said exterior wall onto a second base.

2. The tape dispensing system set forth in claim 1, further characterized in that said dispenser spool assembly further comprises a male locking member mounted on said first front wall and a bolt protruding therefrom.

3. The tape dispensing system set forth in claim 2, further characterized in that said plate spool assembly further comprises a protruding mount mounted on said second base, said protruding mount comprises a through hole, said second base further comprises a female locking member.

4. The tape dispensing system set forth in claim 3, further characterized in that said female locking member has cooperative shape to receive said male locking member when said first front wall is biased against said second base.

5. The tape dispensing system set forth in claim 4, further characterized in that said through hole receives said bolt when said first front wall is biased against said second base and said bolt fastens with a wing nut.

6. The tape dispensing system set forth in claim 1, further characterized in that said at least one first locking cut out receives said second locking edge, and said at least one second locking cut out cooperatively receives said first locking edge when said interior dispenser frame is joined to said exterior dispenser plate.

7. The tape dispensing system set forth in claim 1, further characterized in that a first elongated cut out of said at least one elongated cut out is at a second predetermined distance from said third lateral edge and a second elongated cut out of said at least one elongated cut out is at a third predetermined distance from said fourth lateral edge.

8. The tape dispensing system set forth in claim 7, further characterized in that said first and second elongated cut outs are parallel to each other.

9. The tape dispensing system set forth in claim 1, further characterized in that said top wall of said interior dispenser frame is perpendicular to said exterior wall of said exterior dispenser plate.

10. The tape dispensing system set forth in claim 1, further characterized in that said interior wall of said interior dispenser frame and said exterior wall are parallel to each other.

11. The tape dispensing system set forth in claim 1, further characterized in that said interior wall of said of said interior dispenser frame further comprises at least one belt loop.

12. The tape dispensing system set forth in claim 1, further characterized in that at least one reinforcement wall extends between said top wall and said interior wall.

13. The tape dispensing system set forth in claim 1, further characterized in that said exterior dispenser plate comprises first and second rail assemblies.

14. The tape dispensing system set forth in claim 13, further characterized in that each of said first and second rail assemblies comprises a lateral wall and a second front wall extending from a first edge to a base wall.

15. The tape dispensing system set forth in claim 14, further characterized in that said lateral walls and said second front walls each form an L-shape.

16. The tape dispensing system set forth in claim 14, further comprising an application squeegee having a wall defined by seventh and eighth lateral edges and second and third edges.

17. The tape dispensing system set forth in claim 16, further characterized in that said first and second rail assemblies are cooperative in shape to snuggly receive said application squeegee.

18. The tape dispensing system set forth in claim 1, further characterized in that said dispenser spool assembly and said plate spool assembly receive a roll of tape, a distal end of said roll of tape dispenses through said at least one elongated cut out.

19. The tape dispensing system set forth in claim 7, further characterized in that said dispenser spool assembly and said plate spool assembly receive a roll of tape, a first distal end of said roll of tape dispenses through said first elongated cut out, a second distal end of said roll of tape dispenses through said second elongated cut out.

20. The tape dispensing system set forth in claim 1, further characterized in that said plurality of concave sections extends approximately perpendicular toward said first front wall.

* * * * *